US009433826B1

(12) United States Patent
Comeau et al.

(10) Patent No.: US 9,433,826 B1
(45) Date of Patent: Sep. 6, 2016

(54) GOLF BALL INCORPORATING METALLIC FILM AND METHOD OF MAKING

(71) Applicant: Acushnet Company, Fairhaven, MA (US)

(72) Inventors: Brian Comeau, Berkley, MA (US); Matthew F. Hogge, Plymouth, MA (US); Manjari Kuntimaddi, Raynham, MA (US); Peter L. Serdahl, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/670,550

(22) Filed: Mar. 27, 2015

(51) Int. Cl.
*A63B 37/14* (2006.01)
*A63B 37/00* (2006.01)

(52) U.S. Cl.
CPC ..... *A63B 37/0039* (2013.01); *A63B 37/004* (2013.01); *A63B 37/0076* (2013.01); *A63B 37/14* (2013.01)

(58) Field of Classification Search
CPC ..... A63B 37/0039; A63B 37/004; A63B 37/0076; A63B 37/14
See application file for complete search history.

(56) References Cited

U.S. PATENT DOCUMENTS 3,031,194 A * 4/1962 Strayer ..... A63B 37/0003 273/DIG. 3
5,683,312 A * 11/1997 Boehm ..... A63B 37/0003 473/354
6,142,887 A 11/2000 Sullivan et al.
6,319,563 B1 11/2001 Skrabski et al.
6,406,384 B2 * 6/2002 Sullivan ..... A63B 37/00 473/372
6,432,000 B1 * 8/2002 Nesbitt ..... A63B 37/00 473/351
7,156,919 B2 1/2007 McLaughlin
8,187,677 B2 5/2012 Roumonis
8,507,043 B2 * 8/2013 Stremsdoerfer .... C23C 18/1617 427/299
2009/0169741 A1 * 7/2009 Hogge ..... A63B 37/005 427/241
2009/0291776 A1 * 11/2009 Lin ..... A63B 37/0022 473/353
2010/0075778 A1 * 3/2010 Kamino ..... A63B 37/0003 473/376
2012/0286449 A1 * 11/2012 Michalewich ..... A63B 37/0031 264/279
2014/0250609 A1 * 9/2014 Tutmark ..... D06P 3/24 8/495

OTHER PUBLICATIONS

PF Painting; Sep. 2014; pfonline.com; pp. 22-23.
PF Painting; Sep. 2014; pfonline.com.
Spectra Chrome book and samples.

* cited by examiner

*Primary Examiner* — John E Simms, Jr.
(74) *Attorney, Agent, or Firm* — Margaret C. Barker

(57) ABSTRACT

A golf ball of the invention comprises: a substrate layer formed from at least one of a thermoset or thermoplastic composition and having an outer surface that is pre-modified with a catalytic coating; a metallic film that is formed about the outer surface by contacting the catalytic coating with a mixture comprising: (i) at least one aqueous and/or organic aerosol comprising at least one metal in cationic/oxidizing form; and (ii) at least one reducing agent; and a subsequent layer surrounding the metallic film and formed from at least one of a thermoset composition or a thermoplastic composition. Alternatively, the outer surface is not pre-modified. The subsequent layer may be formed about the metallic film or in some embodiments may surround a coating layer that is disposed between the metallic film and the subsequent layer.

25 Claims, No Drawings

GOLF BALL INCORPORATING METALLIC FILM AND METHOD OF MAKING

FIELD OF THE INVENTION

Durable golf balls exhibiting excellent adhesion between adjacent layers and being manufacturable simply and cost effectively, and methods of making such golf balls.

BACKGROUND OF THE INVENTION

Golf balls are made in a variety of constructions and compositions. Generally, a core is surrounded by a cover, with at least one intermediate layer optionally disposed there between. Examples of conventional golf ball materials range from balata to polybutadiene, ionomer resins, polyurethanes, and/or polyureas. Typically, outer layers are formed about the spherical outer surface of an inner golf ball component via compression molding, casting, or injection molding.

Golf ball manufacturers continuously experiment with constructions and material formulations in order to target and improve aerodynamic and/or inertial properties and achieve desired feel without sacrificing durability. In this regard, metallic layers/films have rarely been incorporated in golf balls despite their potential advantages such as a barrier to moisture vapor penetration into inner layers.

One challenge encountered in previous attempts to incorporate metallic layers/films in golf ball constructions relates to achieving sufficient adhesion between the metallic layer/film and an adjacent layer formed from a thermoset and/or thermoplastic material. Sufficient adhesion between adjacent layers improves impact durability and shear resistance, without which both golf ball appearance and playability commonly suffer.

Additionally, the manufacturing cost was found to be undesirably high since the already existing golf ball manufacturing framework had to be adapted to accommodate processes such as vacuum metallization, electroplating, and/or sputtering. For at least these reasons, prior use of metallics in golf balls has been largely limited to surface paints, pigments, and/or inks.

However, since metallic layers/films remain an attractive option for golf ball constructions, there is a need for golf balls wherein a metallic layer/film may be incorporated about and between any of the core, intermediate layers and cover layers—without the aforementioned adhesion problems, and within existing golf ball manufacturing processes such as chain-on-edge applications. The present inventive golf ball and methods of making same address and solve this need.

SUMMARY OF THE INVENTION

Accordingly, in one embodiment, a golf ball of the invention comprises: a substrate layer formed from at least one of a thermoset or thermoplastic composition and having an outer surface that is pre-modified with a catalytic coating; a metallic film that is formed about the outer surface by contacting the catalytic coating with a mixture $M_1$ comprising: (i) at least one aqueous and/or organic aerosol comprising at least one metal in cationic/oxidizing form; and (ii) at least one reducing agent; and a subsequent layer surrounding the metallic film and formed from at least one of a thermoset composition or a thermoplastic composition. The catalytic coating may be chemisorbed at the outer surface. The catalytic coating may also comprise a coupling agent selected from titanates, aluminates, silanes, zirconates, zircoaluminates or mixtures thereof.

The substrate layer of the golf ball may have the catalytic coating sprayed onto the outer surface. Alternatively, the substrate layer may be dipped in the catalytic coating.

In one embodiment, the catalytic coating may further comprise a wetting liquid. The wetting liquid may be selected from the group consisting of: deionized water; non-deionized water; deionized water containing at least one anionic, cationic or neutral surfactant; non-deionized water containing at least one anionic, cationic or neutral surfactant; a solution comprising at least one alcohol; and mixtures thereof.

The metal of the metallic film is preferably selected from the group consisting of: silver, gold, copper, nickel, zinc, cobalt, tin, boron, tungsten, and combinations thereof. Mixture $M_1$ comprises a reducing agent that can be selected from the group consisting of: sodium borohydrides, dimethylamine borane, hydrazine, sodium hypophosphite, formol, lithium aluminium hydrides, reducing sugars and mixtures thereof.

In a preferred embodiment of the invention, the metallic film may have a thickness of from about 0.1 μm to about 50 μm. Furthermore, a metallic film may be formed that is substantially homogenous.

The metallic film is formed about the outer surface of the substrate layer and between the substrate layer and subsequent layer. In one embodiment, a coating layer is disposed between the metallic film and the subsequent layer. In one embodiment, the coating layer is a catalytic coating.

A golf ball of the invention may include multiple metallic films. For example, a different metallic film may be disposed between a first metallic film and the subsequent layer. In an alternative embodiment, the different metallic film may be disposed between a coating layer and the subsequent layer.

The substrate layer may comprise any golf ball component such as a core layer, intermediate layer, a cover layer or even a coating layer, as long as the resulting golf ball construction is such that the metallic film is formed about the outer surface of the substrate layer, and the subsequent layer surrounds the metallic film. For example, in one preferred embodiment, the substrate layer comprises a polybutadiene core and the subsequent layer comprises a polyurethane cover, with the metallic film being formed about the outer surface of the core and between the core and cover. In this embodiment, the metallic film may be an intermediate layer such as an inner cover layer, for example. As used herein, the term "core" refers to a core having one or more layers. In one embodiment, the substrate layer and subsequent layer may each comprise a core layer. Meanwhile, an intermediate layer is any golf ball layer disposed between the core and an outermost cover layer. Embodiments are also envisioned wherein the substrate layer and metallic film are each intermediate layers.

In still other embodiments, the metallic film is strategically formed about the substrate layer as a moisture barrier layer and having a moisture vapor transmission rate that is lower than that of the substrate layer and/or subsequent layer. In any of these embodiments, the substrate layer and subsequent layer may be formed from similar materials or different materials, but each preferably being formed from at least one of a thermoset or thermoplastic composition.

Alternatively, a golf ball of the invention may comprise: a substrate layer having an outer surface; and a metallic film that is formed about the outer surface by contacting the outer surface with a mixture $M_2$ comprising: (i) a coupling agent; (ii) at least one aqueous and/or organic aerosol comprising at least one metal in cationic (oxidizing) form; and (iii) at least one reducing agent; and a subsequent layer surrounding the metallic film and formed from at least one of a thermoset composition or a thermoplastic composition.

In this embodiment, the first outer surface is not pre-modified by/with a catalytic coating. Instead, the outer surface is contacted with the mixture $M_2$ by at least one of: spraying the mixture onto the outer surface; or dipping the outer surface in the mixture $M_2$.

Alternatively, the invention is directed to a golf ball formed from the steps comprising: (a) providing a catalytic coating; (b) providing: (i) at least one aqueous and/or organic aerosol comprising at least one metal in cationic/oxidizing form; and (ii) at least one reducing agent; (c) providing a substrate layer having a first spherical outer surface; (d) contacting the outer surface with the catalytic coating and forming a pre-modified outer surface; (e) contacting the pre-modified outer surface with a mixture $M_1$ of (i) the at least one aqueous and/or organic aerosol comprising at least one metal in cationic/oxidizing form and the (ii) at least one reducing agent, thereby forming a metallic film concentrically about the outer surface such that the substrate layer and the metallic film are bonded at an interface there between; and forming a subsequent layer about the metallic film that comprises at least one of a thermoset composition or a thermoplastic composition.

In another embodiment, the invention is directed to a golf ball formed from the steps comprising: (a) providing: (i) at least one coupling agent; (ii) at least one aqueous and/or organic aerosol comprising at least one metal in cationic/oxidizing form; and (iii) at least one reducing agent; (b) providing a substrate layer having an outer surface; (c) contacting the outer surface with a mixture $M_2$ of the (i) at least one coupling agent; (ii) at least one aqueous and/or organic aerosol comprising at least one metal in cationic/oxidizing form; and (iii) at least one reducing agent, and forming a metallic film concentrically about the outer surface such that the substrate layer and the metallic film are bonded at an interface there between; and forming a subsequent layer about the metallic film, the subsequent layer comprising at least one of a thermoset composition or a thermoplastic composition.

The invention is also directed to a method of making the golf ball comprising: (a) providing a catalytic coating; (b) providing: (i) at least one aqueous and/or organic aerosol comprising at least one metal in cationic/oxidizing form; and (ii) at least one reducing agent; (c) providing a substrate layer having a first spherical outer surface; (d) contacting the outer surface with the catalytic coating and forming a pre-modified outer surface; (e) contacting the pre-modified outer surface with a mixture $M_1$ of (i) the at least one aqueous and/or organic aerosol comprising at least one metal in cationic/oxidizing form and the (ii) at least one reducing agent, thereby forming a metallic film concentrically about the outer surface such that the first layer and the metallic film are bonded at an interface there between; and forming a subsequent layer about the metallic film, the subsequent layer comprising at least one of a thermoset composition or a thermoplastic composition.

In another embodiment, the method of making the golf ball of the invention comprises: (a) providing: (i) at least one coupling agent; (ii) at least one aqueous and/or organic aerosol comprising at least one metal in cationic/oxidizing form; and (iii) at least one reducing agent; (b) providing a substrate layer having an outer surface; (c) contacting the outer surface with a mixture $M_2$ of the (i) at least one coupling agent; (ii) at least one aqueous and/or organic aerosol comprising at least one metal in cationic/oxidizing form; and (iii) at least one reducing agent, and forming a metallic film concentrically about the outer surface such that the substrate layer and the metallic film are bonded at an interface there between; and forming a subsequent layer about the metallic film, the subsequent layer comprising at least one of a thermoset composition or a thermoplastic composition.

DETAILED DESCRIPTION

A golf ball of the invention cost effectively incorporates a metallic film which may provide many desirable benefits such as protection against moisture penetration. In some embodiments of a golf ball of the invention, the substrate layer is pre-modified with a catalytic coating that promotes adhesion between the substrate layer and the metallic film formed thereabout when mixture $M_1$ is provided thereabout. In other embodiments, a coupling agent, for facilitating such adhesion between the substrate layer and metallic film, is combined into the mixture $M_2$ with the (i) at least one aqueous and/or organic aerosol comprising at least one metal in cationic/oxidizing form; and (ii) at least one reducing agent. This resulting mixture $M_2$ is applied or otherwise provided about or onto the substrate layer, thereby producing the metallic film.

Advantageously, in golf balls of the invention, the metallic film is formed intermediate between an outer golf ball layer and an inner golf ball layer with excellent adhesion between the inner layer (substrate layer) and the metallic film as well as between the metallic film and the outer golf ball layer (the subsequent layer) surrounding the metallic film. Interactions between the metallic film and the substrate layer and/or subsequent layer at an interface there between create sufficient adhesion between the metallic film and an adjacent layer, thereby producing golf ball durability when the golf ball is struck by a club head.

The term "pre-modified", as used herein, shall refer to the outer surface of the substrate layer being modified with the catalytic coating at any time prior to the outer surface being contacted by/with mixture $M_1$.

The catalytic coating may further comprise a wetting liquid. The wetting makes it possible to ensure a homogeneous deposition of the metallic film, by promoting the mixing of the two active ingredients (oxidizing agent and reducing agent) sprayed simultaneously as well as facilitate in spreading the mixture onto the outer surface.

The outer surface can also be subjected to a chemical and/or mechanical treatment. The latter can be by roughening, for example. Chemical treatments such as standard etching solutions may be used. The purpose of these treatments is to increase the adherence of the metallic film onto the outer surface. An activation stage in a colloidal PdSn solution makes it possible to activate to saturation.

Conversion to metal is triggered when mixture $M_1$ or mixture $M_2$ is provided onto the outer surface. The priming or activation of the reaction may be achieved by any physical (temperature, UV etc.) or chemical means. The metals can be advantageously selected, for example, from group VIII of the periodic table as well as from groups Ib, IIb, IIIc, IVa (transition metals) and VI b of the periodic table. Copper, nickel, zinc, cobalt, tin, boron, tungsten and alloys thereof, for example. And different binary and tertiary alloys based on Ni, Co, Zn, Fe, Cu and B can be produced using a mixture of metal salts. Examples of alloys include: Ni—B, Ni—B—Zn, Ni—Cu—B, Ni—Co—B, Ni—Fe—B, Ni—Cu—Co—B, NiSn—B etc.

Numerous methods are known in the golf ball art for applying mixture $M_1$ or mixture $M_2$ onto the outer surface. Further, non-limiting methods for forming metallized films onto surfaces non-electrolytic materials are also set forth in U.S. Pat. No. 8,507,043 of Stremsdoerfer ("'043 Patent"), hereby incorporated by reference herein in its entirety. The '043 patent teaches surface depositions that can be produced for the purposes of decoration, finishing and protection against corrosion (nickel, zinc, Cu, etc).

The aerosols sprayed onto outer surface may be obtained from solutions, advantageously aqueous, of the oxidizing metallic cation(s) and the reducing agent(s), or from rinsing solutions, or also if appropriate, from sensitization and/or activation solutions. The spraying aerosol(s) are generally produced by nebulization and/or atomization of solution(s) and/or of dispersion(s), so as to obtain a spray of droplets of an appropriate size such as less than 100 μm, preferably 60 μm, and still more preferentially comprised between 0.1 and 50 μm.

In one embodiment, the mixture of the oxidizing agent(s) and reducing agent(s) is metastable and, after spraying the mixture, the latter is activated such that the conversion to metal is triggered, preferably by bringing into contact with a primer, advantageously supplied by means of at least one aerosol, before, during or after the spraying of the mixture. This variant makes it possible to pre-mix the oxidizing agent and the reducing agent while slowing down their reaction until they cover the surface of the substrate after spraying. The priming or activation of the reaction is then achieved by any physical (temperature, UV etc.) or chemical means.

In some embodiments, a coating may be disposed between the metallic film and subsequent layer. This coating is a catalytic coating in some embodiments, whereas in other embodiments the coating may serve as a wetting liquid.

The subsequent layer may be formed about the metallic layer by conventional methods extending from at least one of dipping, soaking, rolling, wiping, spraying, coating, or brushing to at least one of compression molding, casting, and injection molding, depending on the material of the subsequent layer to be formed about the metallic layer.

Desirably, golf balls of the invention may be made cost effectively within already existing golf ball manufacturing framework using conventional processes such as chain-on-edge applications, which are well known in the golf ball art. Previously, adaptations had to be made to the already existing golf ball assembly line in order to accommodate atypical steps, electrolytic-based methods, for example.

While not being bound to a particular or specific conventional golf ball manufacturing assembly set-up, a golf ball of the invention may be formed, for example, within or along a conventional golf ball coating booth or line wherein a golf ball component to be surrounded and bonded with a metallic film may be engaged, rotated and sprayed or otherwise contacted with the pre-modification and/or film forming mixtures, followed by curing and/or top coating, etc.

In one embodiment, at least one solution of metallic cation(s) and at least one solution of reducing agent(s) may be simultaneously sprayed onto the outer surface, in one or more aerosols, in the same spraying phase. Mixing of the oxidizing solution with the reducing solution can be carried out just before the formation of the spraying aerosol or also by merging an aerosol produced from the oxidizing solution with an aerosol produced from the reducing solution, preferably, before they come into contact with the outer surface. In another embodiment, at least one exclusive oxidizing metal cation spraying phase and at least one exclusive reducing agent spraying phase are alternated. And several different oxidizing metallic cations and one or more reducing agents may be used so as to produce multiple film layers of different metals or alloys.

Different binary and tertiary alloys based on Ni, Co, Zn, Fe, Cu and B can be produced using a mixture of metal salts. The different salts may be sprayed separately from the reducing agent but also separately from each other and successively.

Water is an excellent solvent, without however excluding the possibility of using organic solvents, for the production of the solutions from which the sprayed aerosols are produced. The concentrations of oxidizing metal salt are comprised between 1 g/l and 60 g/l and preferably between 7 and 30 g/l. The concentrations of reducing agent are comprised between 0.5 g/l and 60 g/l and preferably between 8 and 20 g/l.

At least one of the starting solutions may have the following added to it: at least one natural or synthetic resin or binding agent, at least one organic or inorganic dye and/or pigment; at least one brightening agent, preferably selected from the following products: sulphimides, sulphanamides, sulphonates, propargyl alcohol, thiourea, mercaptabenzothiazole or mixtures thereof; at least one surfactant; at least one filler, preferably selected from the following products: fibres or particles of glass, carbon, silicon carbide, graphite, diamond, oxides such as alumina, ceramics, microcapsules, or also calcium or sodium carbonates, barium sulphates, talc, silicates, in fact any filler capable of modifying the rheological properties and the mechanical properties of the metallic films, and the mixtures of these products.

Numerous other additives may be added, such as in particular viscosity modifying agents such as ethylene glycol. A fine adjustment of the viscosity in fact makes it possible to avoid flow phenomena on the substrate. The reagents therefore remain in contact with the substrate in the same place for a longer time. It follows that the mass deposited and therefore the yield of the oxidation-reduction reaction are improved. On the other hand, the increase in viscosity improves the dispersion and suspension of the particles or fibres in the case of the development of a composite deposition.

In a golf ball of the invention, the substrate layer and/or subsequent layer may be formed from conventional thermoset and/or thermoplastic materials. That being said, a core layer in a golf ball of the invention may for example be solid, semi-solid, fluid-filled, or hollow, and may have a single-piece or multi-piece structure. A variety of materials may be used to make the core including thermoset compositions such as rubber, styrene butadiene, polybutadiene, isoprene, polyisoprene, trans-isoprene; thermoplastics such as ionomer resins, polyamides or polyesters; and thermoplastic and thermoset polyurethane and polyurea elastomers. In one embodiment, the core is a single-piece made from a natural or synthetic rubber composition such as polybutadiene. In other instances, a two-piece core is constructed; that is, there may be two core layers. For example, an inner core portion may be made of a first base rubber material and an outer core layer, which surrounds the inner core, may be made of a second base rubber material. The respective core pieces may be made of the same or different rubber materials. Cross-linking agents and fillers may be added to the rubber materials.

More particularly, materials for solid cores typically include compositions having a base rubber, a filler, an initiator agent, and a cross-linking agent. The base rubber typically includes natural or synthetic rubber, such as polybutadiene rubber. In one embodiment, the base rubber is 1,4-polybutadiene having a cis-structure of at least 40%. The polybutadiene can be blended with other elastomers such as natural rubber, polyisoprene rubber, styrene-butadiene rubber and/or other polybutadienes. Another suitable rubber that may be used in the core is trans-polybutadiene. This polybutadiene isomer is formed by converting the cis-isomer of the polybutadiene to the trans-isomer during a molding cycle. A soft and fast agent such as pentachlorothiophenol (PCTP) or ZnPCTP can be blended with the polybutadiene. These compounds may also function as cis-to-trans catalyst to convert some cis-1,4 bonds in the polybutadiene into trans 1,4 bonds.

Fillers, which may be used to modify such properties as the specific gravity (density-modifying materials), hardness, weight, modulus, resiliency, compression, and the like may be added to the core composition. Normally, the fillers are inorganic, and suitable fillers include numerous metals or metal oxides, such as zinc oxide and tin oxide, as well as barium sulfate, zinc sulfate, calcium carbonate, barium carbonate, clay, tungsten, tungsten carbide, silica, and mixtures thereof. Fillers may also include various foaming agents or blowing agents, zinc carbonate, regrind (recycled core material typically ground to about 30 mesh or less particle size), high-Mooney-viscosity rubber regrind, and the like. In addition, polymeric, ceramic, metal, and glass microspheres may be used.

In one embodiment, the core is a single-piece core having an outside diameter of about 1.20 to about 1.65 inches. Preferably, the single-piece core has a diameter of about 1.62 inches. The core generally makes up a substantial portion of the ball, for example, the core may constitute at least about 90% of the ball. Again, the hardness of the core may vary depending upon the desired properties of the ball. One non-limiting example of such a construction is as follows. The core may be a single-piece polybutadiene core having a diameter of at least about 1.58 inches; the metallic film may have a thickness of from about 0.1 μm to about 50 μm; and a polyurethane cover may have a thickness of less than about 0.070 inches. In one particular embodiment, the metallic film is a moisture barrier layer having a moisture vapor transmission rate that is lower than the moisture vapor transmission rate of the polybutadiene core it surrounds, thereby protecting the core from moisture penetration given that some polyurethane cover materials may be vulnerable to such. In an alternative embodiment, the metallic film is a moisture barrier layer having a moisture vapor transmission rate that is lower than the moisture vapor transmission rate of the polyurethane cover.

In another embodiment, the core may include an inner core portion and surrounding outer core layer. This core structure may be referred to as a multi-core or two-piece core. The inner core portion and outer core layer together may be referred to as the "center" of the ball. In such balls having two-piece cores, the inner core portion may have a diameter of about 0.75 to about 1.30 inches, more preferably 1.00 to 1.15 inches, and be relatively soft (that is, it may have a compression of less than about 30.) Meanwhile, the outer core layer may have a thickness of about 0.20 to about 0.60 inches and be relatively hard (compression of about 70 or greater). That is, the two-piece core or "center" of the ball, which constitutes the inner core and outer core layer, may have a total diameter of about 1.50 to about 1.64 inches, more preferably 1.510 to 1.620 inches, and a compression of about 80 to about 115, more preferably 85 to 110.

In one instance, the core is a two-piece core having a total diameter of about 1.40 inches to about 1.62 inches and comprising an inner core portion having a diameter of about 0.90 inches to about 1.20 inches, and an outer core portion having a thickness of about 0.21 to about 0.36 inches. In such a construction, the metallic film has a thickness of from about 0.1 μm to about 50 μm, and the cover preferably has a thickness of less than 0.070 inches, preferably less than about 0.040 inches. More preferably, the cover has a thickness of about 0.015 to 0.040 inches.

The compression of the core portion is generally overall in the range of about 40 to about 110 and more preferably in the range of about 60 to about 100. In general, when the ball contains a relatively soft core, the resulting spin rate of the ball is relatively low. The compressive force acting on the ball is less when a club strikes the ball and compresses the cover against a relatively soft core. The club face does not fully interface and grasp the ball's surface and thus the initial spin rate on the ball is lower. On the other hand, when the ball contains a relatively hard core, the resulting spin rate of the ball is relatively high. As the club face strikes the ball, it is able to more fully interface and grasp the ball's surface and thus the initial spin rate of the ball is higher. In other embodiments, the overall coefficient of restitution ("COR") of cores of the present invention at 125 ft/s is at least 0.750, or at least 0.775 or at least 0.780, or at least 0.785, or at least 0.790, or at least 0.795, or at least 0.800. Cores are also known to comprise a variety of other materials that are typically also used for intermediate and cover layers. Intermediate layers may likewise also comprise materials generally used in cores and covers as described herein for example.

The cover material should impart durability, toughness and tear-resistance to the ball. For example, polyurethane/polyurea compositions can be used in the cover layer, because they can provide the cover with high durability as well as a soft feel. In other embodiments, the cover may be made of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof.

In one embodiment, ionomer resins can be used as the cover material. These cross-linked polymers contain interchain ionic bonding as well as covalent bonding. The ionomer resins include, for example, a copolymer of ethylene and an acid group such as methacrylic or acrylic acid. Metal ions such as sodium, lithium, zinc, and magnesium are used to neutralize the acid groups in the polymer. Commercially available ionomer resins are known in the industry and include numerous resins sold under the trademarks, Surlyn.®. (DuPont) and Escor.® and Iotek.®. (Exxon). These ionomer resins are available in various grades and are identified based on the type of base resin, molecular weight, type of metal ion, amount of acid, degree of neutralization, additives, and other properties.

As discussed above, suitable cover materials include, but are not limited to, ionomer resins and blends thereof (e.g., Surlyn.®. ionomer resins and DuPont.®. HPF 1000 and HPF 2000, commercially available from E. I. du Pont de Nemours and Company; Iotek.®. ionomers, commercially available from ExxonMobil Chemical Company;

Amplify.®. IO ionomers of ethylene acrylic acid copolymers, commercially available from The Dow Chemical Company; and Clarix.®. ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax.®. thermoplastic polyether block amides, commercially available from Arkema Inc; crosslinked trans-polyisoprene and blends thereof; polyester-based thermoplastic elastomers, such as Hytrel.®., commercially available from E. I. du Pont de Nemours and Company; polyurethane-based thermoplastic elastomers, such as Elastollan.®., commercially available from BASF; synthetic or natural vulcanized rubber; and combinations thereof. In a particular embodiment, the cover is a single layer formed from a composition selected from the group consisting of ionomers, polyester elastomers, polyamide elastomers, and combinations of two or more thereof.

In a second embodiment, the cover may comprise a composition formed from a thermoplastic polyurethane, thermoset polyurethane, thermoplastic polyurea, or thermoset polyurea. More particularly, a polyurea composition can be used as the cover layer. In another version, the cover layer comprises a blend of from about 10% to about 90% by weight of the polyurea composition and from about 90% to about 10% of a polyurethane composition. In yet another embodiment, the cover layer comprises a blend of from about 10% to about 90% by weight of the polyurea composition and from about 90% to about 10% of another polymer or other material such as vinyl resins, polyesters, polyamides, and polyolefins.

Polyurethanes, polyureas, and blends and hybrids of polyurethane/polyurea are also particularly suitable for forming cover layers. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions that can be used include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, that is, as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(.beta.-hydroxyethyl)ether; hydroquinone-di-(.beta.-hydroxyethyl)ether; trimethylol propane; and combinations thereof.

Suitable polyurethane cover compositions also include those formed from the reaction product of at least one isocyanate and at least one curing agent or the reaction product of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p,p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The cover composition is not limited by the use of a particular polyisocyanate. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("H.sub.12MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate may have less than 14% unreacted NCO groups. Preferably, the at least one polyisocyanate has no greater than 8.5% NCO, more preferably from 2.5% to 8.0%, or from 4.0% to 7.2%, or from 5.0% to 6.5%.

The cover composition is not limited by the use of a particular polyol. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(4-hydroxyethyl)ether; hydroquinone-di-(4-hydroxyethyl) ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a pre-polymer method. In this method, the polyisocyanate and the polyol are mixed separately prior to addition of the curing agent. This method affords a more homogeneous mixture resulting in a more consistent polymer composition.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Cover compositions may also include one or more filler(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Suitable cover materials and constructions also include, but are not limited to, those disclosed in U.S. Patent Application Publication No. 2005/0164810, U.S. Pat. Nos. 5,919,100, 6,117,025, 6,767,940, and 6,960,630, and PCT Publications WO00/23519 and WO00/29129, the entire disclosures of which are hereby incorporated herein by reference.

The golf ball of this invention may have single-, dual-, or multi-layered covers preferably having an overall thickness within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In one embodiment, the cover is a single layer having a thickness of from 0.025 inches to 0.035 inches. Again, the cover hardness may be targeted depending on desired playing characteristics. As a general rule, all other things being equal, a golf ball having a relatively soft cover will spin more than a similarly constructed ball having a harder cover.

In the present invention, "compression" is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

In a golf ball if the invention, Coefficient of Restitution or COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. COR is then calculated as the ratio of the outgoing transit time period to the incoming transit time period, $COR=V_{out}/V_{in}=T_{in}/T_{out}$. The COR value can be targeted, for example, by varying the core peroxide and antioxidant types and amounts as well as the cure temperature and duration.

The surface hardness of a golf ball layer is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

It is understood that the golf balls of the invention incorporating at least one metallic film as described and illustrated herein represent only some of the many embodiments of the invention. It is appreciated by those skilled in the art that various changes and additions can be made to such golf balls without departing from the spirit and scope of this invention. It is intended that all such embodiments be covered by the appended claims.

A golf ball of the invention may further incorporate indicia, which as used herein, is considered to mean any symbol, letter, group of letters, design, or the like, that can be added to the dimpled surface of a golf ball.

It will be appreciated that any known dimple pattern may be used with any number of dimples having any shape or size. For example, the number of dimples may be 252 to 456, or 330 to 392 and may comprise any width, depth, and edge angle. The parting line configuration of said pattern may be either a straight line or a staggered wave parting line (SWPL), for example.

In any of these embodiments the single-layer core may be replaced with a two or more layer core wherein at least one core layer has a hardness gradient.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

Although the golf ball of the invention has been described herein with reference to particular means and materials, it is to be understood that the invention is not limited to the particulars disclosed and extends to all equivalents within the scope of the claims.

What is claimed is:

1. A golf ball comprising:

a substrate layer formed from at least one of a thermoset or thermoplastic composition and having an outer surface that is modified with a catalytic coating; and a metallic film that is formed about the outer surface by contacting the catalytic coating with a mixture $M_1$ comprising: (i) at least one aqueous and/or organic aerosol comprising at least one metal in cationic/oxidizing form; and (ii) at least one reducing agent; and a subsequent layer surrounding the metallic film and formed from at least one of a thermoset composition or a thermoplastic composition wherein a catalytic coating is also disposed between the metallic film and the subsequent layer; and wherein interactions at an interface between the metallic film and each of the substrate layer and the subsequent layer promote adhesion there between.

2. The golf ball of claim 1, wherein the catalytic coating is chemisorbed at the outer surface.

3. The golf ball of claim 2, wherein the catalytic coating comprises a coupling agent selected from titanates, aluminates, silanes, zirconates, zircoaluminates or mixtures thereof.

4. The golf ball of claim 2, wherein the catalytic coating further comprises a wetting liquid.

5. The golf ball of claim 4, wherein the wetting liquid is selected from the group consisting of: deionized water; non-deionized water; deionized water containing at least one anionic, cationic or neutral surfactant; non-deionized water containing at least one anionic, cationic or neutral surfactant; a solution comprising at least one alcohol; and mixtures thereof.

6. The golf ball of claim 5, wherein the substrate layer is contacted with the catalytic coating by at least one of: spraying the catalytic coating onto the outer surface; or dipping the outer surface in the catalytic coating.

7. The golf ball of claim 1, wherein the metal is selected from the group consisting of: silver, gold, copper, nickel, zinc, cobalt, tin, boron, tungsten, and combinations thereof.

8. The golf ball of claim 1, wherein the reducing agent is selected from the group consisting of: sodium borohydrides, dimethylamine borane, hydrazine, sodium hypophosphite, formol, lithium aluminium hydrides, reducing sugars and mixtures thereof.

9. The golf ball of claim 1, wherein the metallic film has a thickness of from about 0.1 μm to about 50 μm.

10. The golf ball of claim 3, wherein the metallic film is substantially homogenous.

11. The golf ball of claim 1, wherein the subsequent layer is formed from a polyurethane composition.

12. The golf ball of claim 1, wherein a different metallic film is disposed between the metallic film and the subsequent layer.

13. The golf ball of claim 1, wherein a different metallic film is disposed between the coating layer and the subsequent layer.

14. The golf ball of claim 1, wherein the substrate layer comprises a core layer.

15. The golf ball of claim 1, wherein the substrate layer comprises an intermediate layer.

16. The golf ball of claim 1, wherein the substrate layer comprises a cover layer.

17. The golf ball of claim 1, wherein the metallic film has a moisture vapor transmission rate that is lower than a moisture vapor transmission rate of the subsequent layer.

18. The golf ball of claim 1, wherein the metallic film is an inner cover layer and is surrounded by an outer cover layer comprising a polyurethane composition.

19. The golf ball of claim 1, wherein the metallic film has a moisture vapor transmission rate that is lower than a moisture vapor transmission rate of the substrate layer.

20. A golf ball comprising:

a substrate layer having an outer surface; and a metallic film that is formed about the outer surface by contacting the outer surface with a mixture $M_2$ comprising: (i) a coupling agent; (ii) at least one aqueous and/or organic aerosol comprising at least one metal in cationic (oxidizing) form; and (iii) at least one reducing agent; and a subsequent layer surrounding the metallic film and formed from at least one of a thermoset composition or a thermoplastic composition;

wherein interactions at an interface between the metallic film and each of the substrate layer and subsequent layer promote adhesion.

21. The golf ball of claim 20, wherein the metallic film has a thickness of from about 0.1 μm to about 50 μm.

22. The golf ball of claim 20, wherein the metallic film is substantially homogenous.

23. The golf ball of claim 20, wherein the substrate layer is contacted with mixture $M_2$ by at least one of: spraying the mixture onto the outer surface; or dipping the outer surface in mixture $M_2$.

24. The golf ball of claim 20, wherein the metallic film has a moisture vapor transmission rate that is lower than a moisture vapor transmission rate of the substrate layer.

25. The golf ball of claim 20, wherein the metallic film has a moisture vapor transmission rate that is lower than a moisture vapor transmission rate of the subsequent layer.

* * * * *